US005954063A

United States Patent [19]

Pomaro

[11] Patent Number: 5,954,063

[45] Date of Patent: Sep. 21, 1999

[54] ADJUSTABLE HAIR CUTTING DEVICE

[76] Inventor: Anthony Cosmo Pomaro, 222 Bay 41st St., Brooklyn, N.Y. 11214

[21] Appl. No.: 08/893,885

[22] Filed: Jul. 11, 1997

Related U.S. Application Data

[63] Continuation-in-part of application No. 08/665,456, Jun. 18, 1996, abandoned.

[51] Int. Cl.[6] ..... A45D 24/36

[52] U.S. Cl. ..... 132/213

[58] Field of Search ..... 132/213, 213.1, 132/214, 273, 275, 319; 2/12, 174, 24, 468; D28/10, 44; 119/815, 855, 865, 814, 817, 850, 856, 857; 602/6, 17, 18

[56] References Cited

U.S. PATENT DOCUMENTS

| | | | |
|---|---|---|---|
| 1,451,562 | 4/1923 | Babcock | 132/213 |
| 1,639,804 | 8/1927 | Lewis | 132/213 |
| 2,539,198 | 1/1951 | Metzler | 132/214 |
| 2,771,081 | 11/1956 | Shirmeyer et al. | 132/213 |
| 3,209,516 | 10/1965 | Hyman | 119/817 |
| 4,091,766 | 5/1978 | Colliard | 119/865 |
| 4,481,680 | 11/1984 | Mason et al. | 2/174 |
| 4,698,852 | 10/1987 | Romero | 2/171 |
| 5,023,954 | 6/1991 | Lyons | 2/174 |
| 5,307,764 | 5/1994 | Moy | 119/815 |
| 5,379,726 | 1/1995 | Mann | 119/856 |

FOREIGN PATENT DOCUMENTS

| | | | |
|---|---|---|---|
| 121547 | 2/1971 | United Kingdom | 132/275 |

*Primary Examiner*—Todd E. McManahan
*Attorney, Agent, or Firm*—Martin Smolowitz

[57] ABSTRACT

A hair cutting and styling device includes a semi-rigid inner band member which has a curved generally semi-circular shape and is sized to substantially encircle the head of a user and be retained in place by an elongated strap member attached onto one end of the inner band member. The elongated strap member is formed of a detachable hook and loop fastening material such as VELCRO®, which permits the device to be releasably retained on the head of a person whose hair is being cut and styled. Alternatively, the device inner band member first portion may include a bendable metal strip and the strap portion includes an elastic fabric segment.

7 Claims, 3 Drawing Sheets

FIG. 1
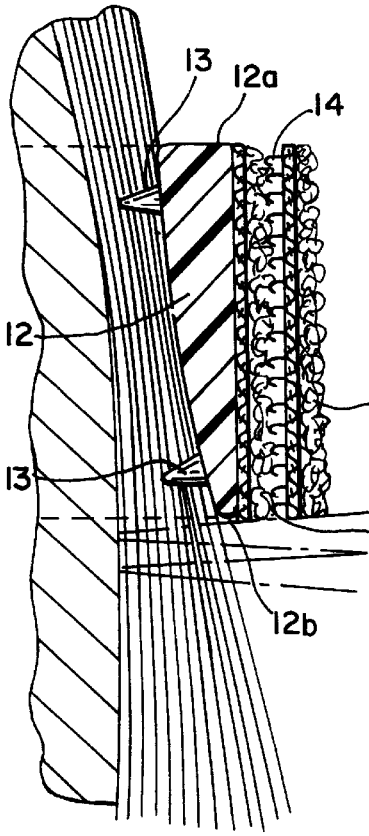
FIG. 3
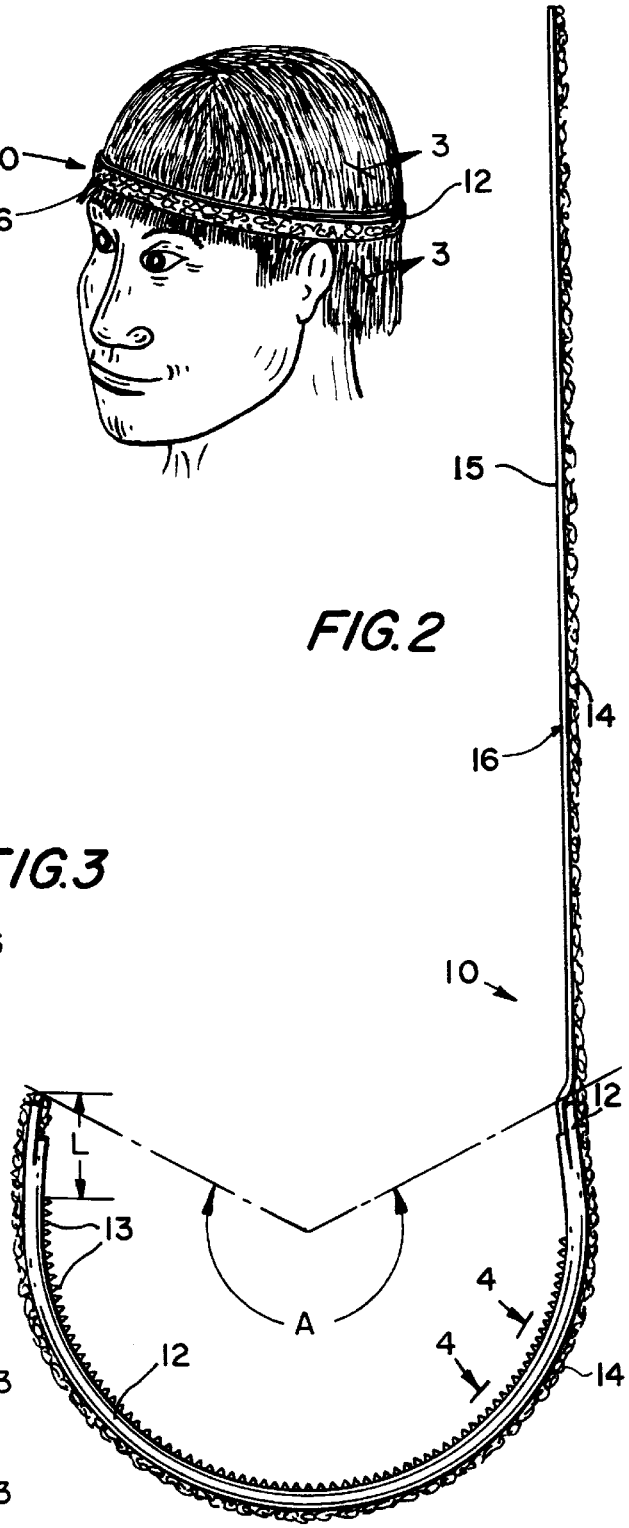
FIG. 2
FIG. 4
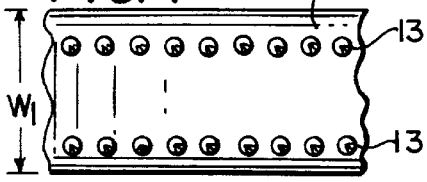

ADJUSTABLE HAIR CUTTING DEVICE

This is a continuation-in-part application of Ser. No. 08/665,456 filed Jun. 18, 1996 now abandoned.

This invention pertains to a hair cutting device adapted for placement on the head of a person for assistance in accurately cutting and styling the person's hair. The invention is particularly directed to such a hair cutting and styling device that is adapted for adjustably and detachably encircling the head of a person whose hair is being cut.

Various hair holding or positioning devices having the form of loops or bands are known from the prior art; however, none are designed to have the simplicity of operation as provided by the present device. Furthermore, none of the prior art devices are designed to assure positive cutting action and uniform shaping of the hair as occurs with the present invention. For example, U.S. Pat. No. 5,301,696 discloses a pony tail holder formed of a band of elastic material with fabric surrounding the band and forming projections to engage the hair when the band is twisted around the hair. U.S. Pat. No. 5,413,126 discloses a decorative hair accessory in the form of an elastic band surrounded by bunched fabric which encircles a length of hair and is secured in close proximity to the head. U.S. Pat. No. 5,388,598 is directed to a hair restraint band formed by a pair of interlocking loops together with a decorative feature. U.S. Pat. No. 5,383,480 discloses a hair waving device for developing parallel waves extending out from a persons scalp and in which a band is used together with a plurality of flexible members which extend from one side of the head to the other over the hair to assist in combing to form a wave. Also, U.S. Pat. No. 5,577,520 to Sluder discloses a hair cutting aid for adjustable placement around a person's head and includes a brim portion for retaining hair clippings. However, these known hair holding devices each have deficiencies and lack flexibility and convenience in their usage for cutting and styling a person's hair.

SUMMARY OF INVENTION

The main object of the present invention is to provide a new and improved hair cutting and styling device adapted for convenient use in cutting and styling a person's hair evenly and with uniform strokes away from the head.

Another object of the invention is to provide an improved device useful for precise holding while cutting and shaping a person's hair, i.e. in bangs, mushroom styles, cutting on a bias, and the like.

Still another object of the invention is to provide an adjustable hair cutting and styling device which is inexpensive and simple to use, it having a variety of placement capabilities on the head of a user by adjustment of a detachable fastening arrangement for diversified hair styling, so as to assure a desirable uniform result.

The hair cutting and styling device of this invention according to one embodiment includes a curved inner semi-rigid band member which has semi-circular shape and is adapted to be placed around the hair and head of a user. The inner band member is provided at one end with an elongated adjustable strap fastening member adapted for positioning and retaining the device on the head of the user. The device curved semi-rigid inner band member preferably has an included angle of 180–250° and has a tapered cross-sectional shape so as to slope downwardly from the head of a user, so that hair cutting is performed in a direction away from the user's head. The device is reliably retained on the head of a user by the elongated adjustable outer strap member which is attached to one end of the curve inner band member and the strap other end is removable attachable onto the inner band member outer surface by a suitable hook and loop fastening material such as VELCRO™. During use of the device, each stroke made by a hair clipper or scissors is guided by the device outer surfaces, so as to permit the hair to be advantageously cut across the lower edge of the device as it is oriented in close proximity to the head at a designated position, depending on the style of haircut desired by the user.

In another desirable embodiment of the invention, the hair cutting and styling device includes an inner band member formed by an elongated elastic fabric outer strips which is bonded fixedly together with a shorter inner fabric strip, and both strips enclose a bendable metal strip provided in the inner band member central portion. The band member inner elastic strip has sufficient length to extend substantially around the head of a user, and is 12–15 inches long. An elongated strap member is attached integrally to one end of the inner band member and includes an elastic strip element. Also, one element of a hook and loop fastening unit such as VELCRO™ is bonded onto the elongated strap outer end. The strap member outer end is releasable attachable onto the other element of the hook and fastening unit which is bonded onto the inner band member outer surface.

BRIEF DESCRIPTION OF DRAWINGS

The present invention will be further described and best understood with reference to the following drawings, in which:

FIG. 1 is a perspective view which generally illustrates how the hair cutting and styling device is placed on the head of a person using the device;

FIG. 2 shows an extended plan view of the device;

FIG. 3 is a sectional elevation view taken along line 3—3 of FIG. 1;

FIG. 4 is a fragmented elevational view taken along line 4—4 of FIG. 2 illustrating the inner band surface of the device;

DESCRIPTION OF INVENTION

Figure 5:
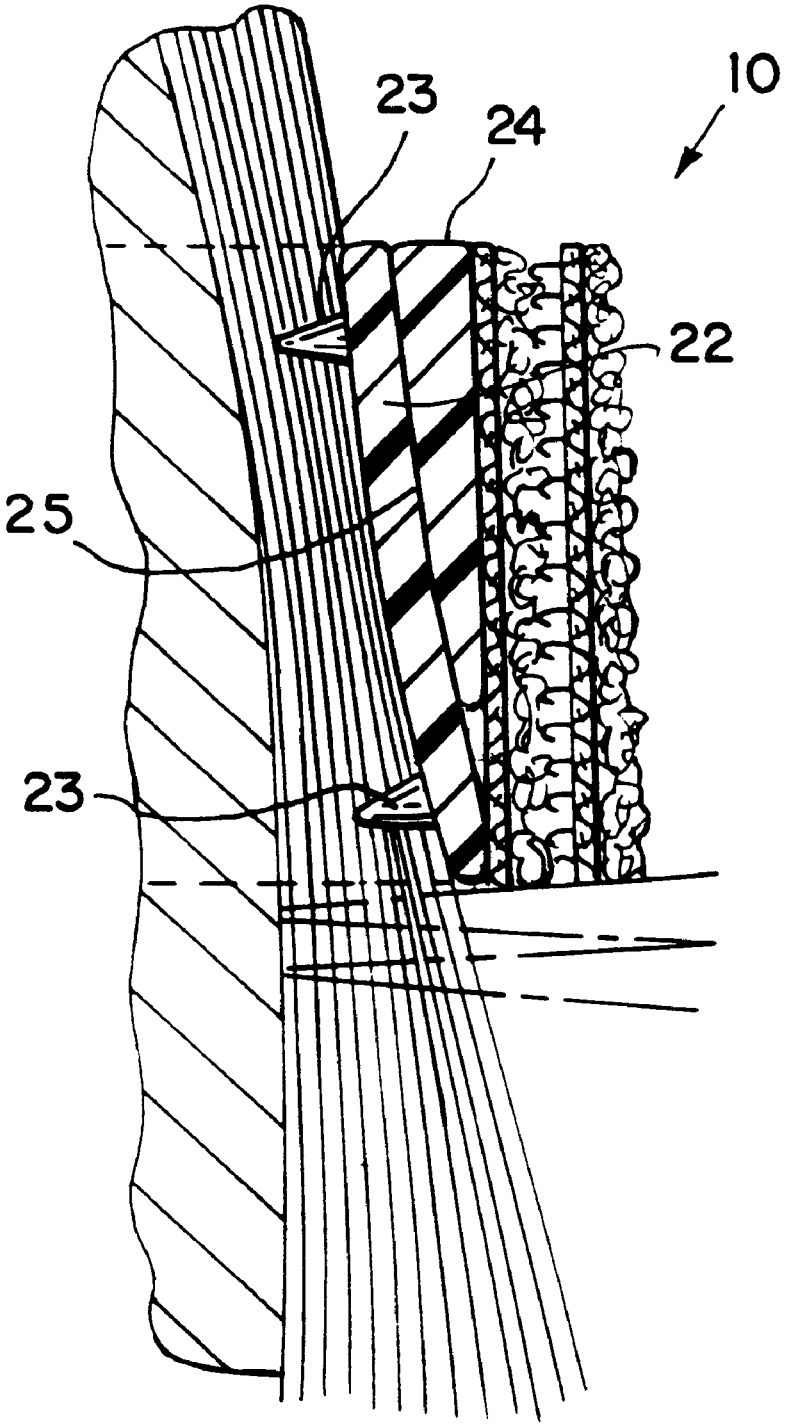
FIG. 5 is a sectional elevation view similar to FIG. 3 except showing an alternative construction of the device.

According to the first embodiment of this invention and as generally shown in FIGS. 1–4, the adjustable hair cutting and styling device 10 includes a curved relatively stiff inner band member 12 which is formed of a molded semi-rigid plastic material. As shown in FIG. 2, the inner band member 12 has a generally semi-circular shape with an included angle "A" of 180–250° and is of sufficient length and size to extend substantially circumferentially about or around the head and hair of a person using the device. As further shown in FIGS. 3 and 4, the inner band member 12 is solid and includes two generally parallel rows of multiple integrally formed projections 13 which extend inwardly and are spaced apart uniformly and extend for substantially the entire length of the inner band member 12. The inner band member 12 has a cross-sectional shape which is tapered and substantially thicker along one edge, which is preferably upper edge 12*a* as compared to the thickness of its opposite or lower edge 12*b*, and thereby imparts a sloping characteristic to the device when attached onto the head of a user.

As shown in FIGS. 2 and 3, an outer band member is provided in the form of an elongated strap member 16 which is attached onto one end of inner band member 12 and consists of an outer layer 14 of felted or lopped elements and bonded onto an inner liner layer 15 containing multiple small hooks. A portion 14*a* of the outer felted layer 14 extends over the outer surface of the curved inner band member 12. During use, the strap member 16 inner hooked layer 15 is removably attached or fastened onto the outer felted surface of layer 14*a* provided the inner band member 12. The two mating layers 14, 15 of the strap member 16 are attached integrally to one end of the inner band member 12, and the strap extends for a sufficient length such as 12–16 inches so as to be attachable to the outer felted surface 14*a* of the inner band member 12, and thereby fit about the circumference of a average size head of a user whose hair is to be cut and styled. A suitable fastening material for this strap member 16 is mating hook and loop material such as VELCRO® which has multiple small hooks on the layer 15 which interlock with multiple small loops on the strap outer layer 14. Because the strap member 16 is provided with the multiple hooks on the inner layer 15 for detachable contacting the felted outer layer 14*a*, the construction permits removable attachment of the cutting device 10 to be consistent with the shape of the individual's head and the intended hair styling.

The inner band member 12 should have a width "W" of 0.625–1.00 inch, a thickness of about 0.100–0.150 inch, and is usually molded of a semi-rigid plastic material such as polyethylene and polystyrene. Inner band member 12 also has provided on its inner surface at least one row and preferably two substantially parallel rows of integral conical-shaped projections 13, each having a base diameter of 0.040–0.060 inch and height of 0.030–0.040 inch. The projections 13 are substantially evenly spaced apart sufficiently to provide 8–10 projections per linear inch of band length, and extend to within a length "L" of about 1.0–1.2 inches from each end of the inner band member 12.

An alternative construction for the hair cutting and styling device inner band member is shown by FIG. 5. Instead of the inner band member 12 having an integral tapered cross-sectional shape as shown in FIG. 3, the inner band member of FIG. 5 includes an inner element 22 which has a uniform thickness of 0.100–0.125 inch and includes multiple inner spaced-apart projections 23 similar to projections 13 of FIGS. 3 and 4. A separate elongated outer element 24 having a tapered cross-sectional shape and maximum thickness of 0.9–1.1 times that of inner band element 22 is bonded firmly by a suitable adhesive material along joint 25 onto the outer surface of the inner band member 22. The elongated strap member 26 is constructed of an inner and outer layer having an attachable hook and loop fastening material similarly as for the strap member 16 of the FIGS. 1–3 construction.

In operation, the adjustable hair cutting device 10 is placed at a desired position about or around an individual's head and hair, with the thicker portion 12*a* of inner band member 12 (see FIG. 3) or thicker portion 24*a* of the element 24 facing upwardly (see FIG. 5). After the device 10 is in place it can be disposed evenly across or at a designated angle or orientation on the person's head, so as to position the hair for particular desired cutting and styling. With the present invention, the stylist can adjust the device 10 so that it remains firmly in place due to the fastening strap 16 and the gripping action of the multiple inner projections 13 or 23 onto the surface of the user's head, with the device being preferably arranged so that the thicker edge portion of the inner band member 12 or the band elements 22, 24 face upwardly. With the device 10, the hair cutter or stylist is provided with an adjustable guide in assuring clean, uniform and desired hair cutting and styling patterns, all in relation to the particular placement of the device on the person's head.

Figure 6:
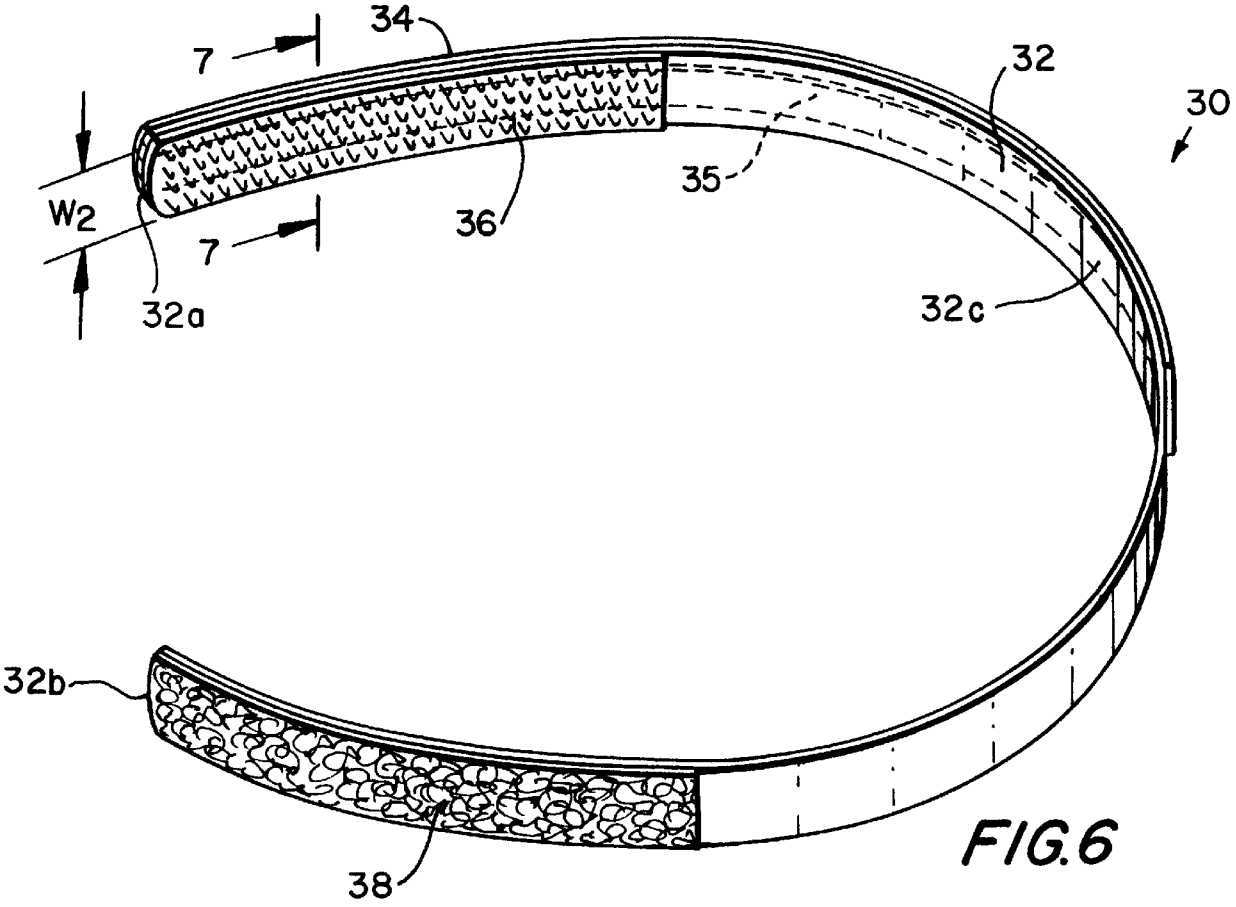
FIG. 6 shows a perspective view of an alternative construction embodiment of the hair cutting and styling device according to the invention.
Figure 7:
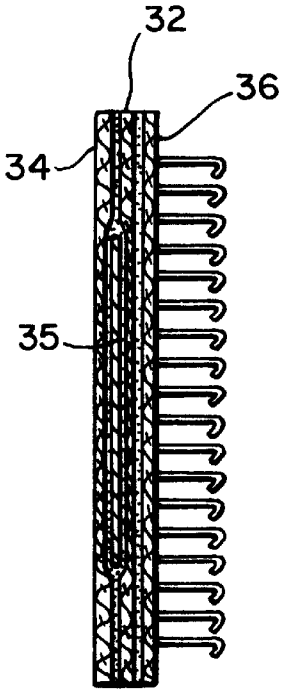
FIG. 7 is a sectional view taken along line 7—7 of FIG. 6.

Another useful embodiment of the present invention is shown by FIGS. 6 and 7, in which hair cutting device 30 includes an elongated woven elastic band element 32 which extends the entire length of the device, which is preferably 24–36 inches. Extending from a first end 32*a* of the device 30 as depicted in the lower portion of FIG. 6, a second fabric strip 34 is provided adhesively bounded along joint 33 onto the inner surface of the elastic band element 32 so as to structurally stabilize the band. The fabric band inner strip 34 extends to about the mid point of the elastic band 32, and preferably has a length of 12–15 inch and band 32, 34 has a width "W2" of 0.80–1.10 inch. Located between the elastic band 32 and inner bonded fabric strip 34, is a relatively thin bendable strip 34 of a metal such as aluminum or copper which provides added stiffness and stability to the central portion of the device 30. The metal strip 35 should have a thickness of 0.010–0.20 inches and a width of 0.70–1.00 inches, with its width being about 90% that of the elastic bands 32 and 34.

A strip 36 of one element of a hook and loop fastening material such as VELCRO® is adhesively bonded onto the outer surface of the first end portion 32*a* of the bonded elastic band 32. This strip element 36 extends from the first end 32*a* to about half the length of inner strip 34. Located at the opposite end 32*b* of the device 30 is an elongated strip 38 of the mating element of the hook and loop fastening material which is 5–7 inches long. It is usually preferred that strip 36 construction leaves a central elastic band portion 32*c* that is 6–8 inches long. Also, it is usually preferred that strip 36 be the hooked layer part and that the strip 38 be the felted or looped layer part of the hook and loop fastening material such as VELCRO™. During placement of the hair cutting device 30 around the head of a person whose hair is to be cut, it will be understood that the strip 38 is attached onto the mating strip 36 so as to retain the device 30 onto the head of the person whose hair is to be selectively and stylishly cut.

Although this invention has been disclosed broadly and also as preferred embodiments, it will be understood that modifications and variations can be made within the scope of the invention as defined by the claims.

I claim:

1. An adjustable hair cutting and styling device, comprising:

a curved elongated inner semi-rigid band member having a semi-circular shape and adapted for being placed about the hair on the head of a person; said curved inner band member including an inner band element having uniform thickness and a second outer band element having a tapered cross-section shape which is bonded onto an outer surface of the inner band element, so that the inner band member has an increased thickness along one edge; and an elongated flexible strap member attached onto one end of said inner band member; said strap member being formed of an outer layer of felted fabric material and an inner liner layer which is coextensive with and bonded onto an inner surface of the elongated strap member outer later said outer layer member also being extended over and bonded onto the outer surface of said inner band member, said strap member inner liner layer being releasably attachable onto the outer fabric material on the curved inner band member, whereby the curved inner band member can be placed around the head of a person whose hair is to be cut and styled, and releasably retained on the person's head by the elongated flexible outer strap member being attached firmly onto the outer fabric material layer of the inner band member.

2. The hair cutting device and styling of claim 1, wherein said curved inner band member has multiple inward projections provided in two substantially parallel rows in a spaced apart arrangement along an inner surface of the inner element of the inner band member.

3. The hair cutting and styling device of claim 1, wherein said inner band member has an included angle of 180–250°.

4. An elongated adjustable device for cutting and styling a person's hair, the device comprising:

an elongated band member formed of an outer elastic fabric material, and having said band member having an inner layer adhesively bonded onto a first portion of the band member length extending from a first end to substantially a midpoint of the band member length;

a bendable metal strip provided between said band member outer elastic material and the inner layer adhesively bonded thereto;

said band member having a short length of one part of A hook and loop fastening material adhesively bonded onto the band member rearward side at the band member first end, and said band member also having a second end and having a strip element formed of the other part of the mating hook and loop fastening material adhesively bonded onto an inner surface of the band member;

whereby the elongated band member can be placed around the head of a person whose hair is to be cut and styled and releasably retained on the person's head by the elongated band member second end being releasably attached onto the rearward side of the elongated band member first end.

5. The hair cutting and styling device of claim 4, wherein the elastic band member has a width of 0.80–1.10 inch and the bendable metal strip has a width of 0.70–1.00 inches.

6. The hair cutting and styling device of claim 4, wherein said elongated outer elastic fabric material includes an unbonded portion located at a central intermediate position along its length.

7. The hair cutting and styling device of claim 4, wherein said band member first end has the loop portion of the hook and loop fastening material and the second end has the hook portion of the fastening material attached thereon.

* * * * *